United States Patent [19]

Day et al.

[11] Patent Number: 4,971,757

[45] Date of Patent: Nov. 20, 1990

[54] METHOD FOR PREPARING DENSE TUNGSTEN INGOTS

[75] Inventors: James Day, Scotia; Thomas J. Stanley; Rony A. Sanchez-Martinez, both of Schenectady, all of N.Y.

[73] Assignee: General Electric Company, Schenectady, N.Y.

[21] Appl. No.: 522,394

[22] Filed: Apr. 30, 1990

Related U.S. Application Data

[63] Continuation of Ser. No. 414,358, Sep. 29, 1989, abandoned.

[51] Int. Cl.[5] ..... B22F 1/00

[52] U.S. Cl. ..... 419/23; 419/26; 419/39; 419/49; 419/68; 75/248

[58] Field of Search ..... 419/23, 26, 39, 49, 419/68; 75/248

[56] References Cited

U.S. PATENT DOCUMENTS 4,458,599 7/1984 Mullendose et al. ..... 75/248
4,801,330 1/1989 Bose et al. ..... 75/248

OTHER PUBLICATIONS

"Cold Isostatic Pressing of Metal Powders", Metals Handbook, 9th Edition, vol. 7, pp. 444–450.
Application Ser. No. 364,388, filed Jun. 12, 1989.
Kirk–Othmer, Encyclopedia of Chemical Technology, Third Edition, vol. 20, pp. 38–64.
Metals Handbook, 9th Edition, vol. 7, p. 6.
Metals Handbook, "Hot Isostatic Pressing of Metal Powders", 9th Edition, vol. 7, pp. 419–443.

*Primary Examiner*—Stephen J. Lechert, Jr.
*Attorney, Agent, or Firm*—William H. Pittman; James C. Davis, Jr.

[57] ABSTRACT

Dense tungsten ingots are prepared by hot isostatically pressing at a temperature of about 1500° to about 1700° C. and a pressure of about 20 to about 30 ksi for about 2 to about 3 hours a refractory container comprising a green tungsten metal compact in contact with a dopant, the tungsten metal of the compact being formed prior to contact with the dopant; the dopant being a material which is insoluble in tungsten and contains molecules having atomic radii greater than the atomic radius of tungsten by at least about 15%.

32 Claims, No Drawings

METHOD FOR PREPARING DENSE TUNGSTEN INGOTS

This application is a continuation of application Ser. No. 07/414,358, filed Sept. 29, 1989, abd.

BACKGROUND OF THE INVENTION

This invention relates to a method for preparing dense tungsten ingots. More particularly, this invention relates to an improved method for preparing dense tungsten ingots for use in the manufacture of lamp wire.

Lamp quality tungsten wire contains small bubbles aligned in long rows parallel to the wire axis in the recrystallized tungsten filaments. Typically, although not necessarily, these bubbles contain potassium vapor. Potassium is introduced into the filament by doping tungsten powder with potassium-containing compounds and then sintering the powder to form a potassium-doped ingot. Potassium is essentially insoluble in tungsten and will reside in small pores which are refined during deformation processes to form the above-mentioned bubbles. Operation of the filament in the lamp is typically carried out at about 2900° K. Potassium, which has a boiling point of about 1032° K., evaporates, filling the bubbles with potassium vapor.

Cold-drawn wire undergoes recrystallization so as to convert the distorted grains in the cold-drawn wire to undistorted grains. The rows of bubbles prevent the grain boundaries in the recrystallized wire from moving perpendicular to the wire axis. The pinning of the grain boundaries in their motion provides the wire with an interlocking grain structure which results in a long-life filament. The absence of these bubbles results in grain boundary sliding and rapid failure of the filament. It is necessary, therefore, that the filament contain potassium or other material which will produce the bubbles described above.

In the current method for making dense tungsten ingots, tungsten oxide is doped with aqueous solutions of potassium disilicate and aluminum chloride. Residues of these dopants remaining on the surface of the oxide grains are removed by acid washing, for example, with hydrochloric and hydrofluoric acid. Before washing, the doped tungsten oxide is reduced to metal powder. The washed reduced tungsten powder, which contains traces of potassium, aluminum, and silicon as salts inside the individual grains, is ram pressed to form a porous green compact which is so fragile that it must be presintered at 1200° C. to impart adequate structural integrity thereto. The ingot is then resistance sintered at about 3000° C. to close up the porosity. During sintering, the aluminum and silicon dopants are evaporated away while much of the potassium is retained. The density of the sintered ingot is about 92% of theoretical density.

In the method described above, aluminum and silicon are necessary for retention of adequate levels of potassium during reduction of the tungsten oxide. Potassium metal is extremely volatile at reduction temperatures and cannot be incorporated into the tungsten during reduction of the oxide. Doping is achieved by adding the aluminum chloride and potassium disilicate to the tungsten oxide and then reducing the oxide, during which some of the dopants are encapsulated within the tungsten grains. The aluminum chloride and potassium disilicate react with the tungsten oxide to form high molecular weight potassium/aluminum/silicon/tungsten compounds that are stable in hydrogen at reduction temperatures and as a result are able to be incorporated within the grains. The high molecular weight potassium/aluminum/silicon/tungsten compounds decompose at the high temperatures used in sintering the tungsten powder to form the ingot. Aluminum and silicon diffuse out of the ingot and evaporate away, while much of the potassium, which is insoluble in tungsten, is retained in the form of particles residing in pores inside the ingot. Because the high molecular weight compounds formed from the dopants in the above process decompose at sintering temperatures, resulting in the loss of the aluminum and silicon, it is necessary to add the dopants prior to the formation of the metal powder in order to incorporate and retain volatile potassium in the doped tungsten.

It is to be understood that while potassium-containing dopants are used in the conventional method described above, it is known in the art that other dopants can also be used.

Aluminum and silicon, which are required in the conventional process described above, have been found to be detrimental to wire quality. As a result, it is desirable to provide a method for making dense tungsten ingots which does not use aluminum or silicon.

In the prior art method described above, most of the potassium introduced in the process in the form of potassium disilicate will be lost in the acid washing step whereby dopant residues not incorporated into the tungsten are removed from the surface thereof. Some potassium will also be lost in the sintering step. The amount of potassium which will be lost in these ways is uncertain. As a result, it is uncertain how much potassium disilicate and aluminum chloride should be doped in the tungsten oxide at the beginning of the ingot-forming process in order to obtain the desired amount of potassium in the final ingot.

It is further desirable, therefore, to provide a method for making dense tungsten ingots which provides greater certainty as to the amount of dopant which should be doped into the tungsten metal in order to obtain the desired amount of dopant in the final ingot.

A drawback to the ingot formed in the conventional method described above is the presence therein of a relatively significant gradient in potassium concentration, i.e., generally about 15 ppm of potassium with respect to tungsten, between the center and outer surface of the ingot. This gradient is a result of sintering, which provides a driving force for removal of potassium from the ingot, thereby leading to an uneven distribution of potassium in the ingot.

It is desirable to provide a method for making a dense tungsten ingot wherein such a gradient is minimized and the ingot has a relatively uniform distribution of dopant.

As mentioned above, the tungsten ingot formed in the conventional process has a density of about 92% of theoretical density. The workability of a tungsten ingot for purposes of preparing wire by rolling, swaging, and wire drawing is dependent on its density, with higher densities being preferred.

It is desirable to provide a method for making a denser tungsten ingot.

It is also desirable to provide a simpler and faster method for making a dense tungsten ingot.

SUMMARY OF THE INVENTION

The present invention provides an improved method for preparing a dense tungsten ingot, comprising hot isostatically pressing at a temperature of about 1500° to about 1700° C. and a pressure of about 20 to about 30 ksi for about 2 to about 3 hours a refractory container comprising a green tungsten metal compact in contact with a dopant, the tungsten metal of the compact being formed prior to contact with the dopant; the dopant being a material which is insoluble in tungsten and contains molecules having atomic radii greater than the atomic radius of tungsten by at least about 15%; and the container comprising a refractory material.

Doping of the tungsten metal is achieved by one of two techniques. In one technique, the dopant is added to reduced tungsten metal powder. In a second technique, the dopant and an undoped tungsten green compact are containerized in a refractory material and subjected to hot isostatic pressing during which process the dopant diffuses into the ingot.

The method provided by this invention provides substantially greater control over the quality of the wire formed from the dense tungsten ingot by not using aluminum or silicon. According to the method of the present invention, the dopants are added after reduction of the tungsten oxide to the metal and not prior thereto. Thus, potassium and other dopants suitable for use herein are not subjected to the high reduction temperatures which in the conventional method described above necessitate the use of aluminum and silicon.

The present method further provides greater certainty in obtaining the desired amount of dopant in the final ingot by not exposing the dopant to the steps used in the conventional method which lead to loss of the dopant, i.e., reduction of doped tungsten oxide and sintering of the doped green compact.

The method of this invention also provides a dense tungsten ingot wherein the ingot has a relatively uniform distribution of dopant. This is achieved by densifying the ingot with hot isostatic pressing rather than by sintering. In the hot isostatic pressing process, there is no loss of dopants by diffusion through the sealed container. Hence, no gradient in dopant concentration across the ingot radius develops, resulting in an ingot having a more homogeneous structure and properties. Thus, the use of hot isostatic pressing to densify the compact in the method of this invention also results in an ingot having greater density than the ingot formed in the conventional method, resulting in improved workability of the ingot for subsequent fabrication by rolling, swaging, and wire drawing.

In addition, the method of this invention is simple and relatively fast.

DETAILED DESCRIPTION OF THE INVENTION

The present invention is directed to a method for making a dense tungsten ingot. The tungsten metal powder used to form the dense ingot according to the present invention is typically a fine powder having an average particle size in the range of about 0.5 to about 10 microns, with a particle size of about 0.5 to about 1 micron being preferred.

The shape of the tungsten particles is important to the present invention. During compaction of the tungsten powder, the bonding between the particles will depend largely on the contact surfaces. The bonding is limited to areas of contact formed by the abrasion between the particles. Angular or irregular shapes produce greater interlocking between the particles than do spherical shapes, and for that reason, are preferred.

The tungsten metal powder can be prepared by the reduction of tungsten oxide or ammonium paratungstate with hydrogen at temperatures of about 760° C. according to methods known in the art. Reduction can be carried out, for example, by stoking the oxide or ammonium paratungstate through tubes in trays with a countercurrent hydrogen flow. The tubes and trays are made of nickel, nickel alloys, or molybdenum. Another technique for reduction uses a rotary kiln device wherein tungsten oxide or ammonium paratungstate is moved through a rotating tube having a countercurrent hydrogen flow.

The reduced tungsten metal powder may then undergo doping to form doped tungsten metal powder or it may undergo pressing to form a green tungsten compact which will be doped in a subsequent step.

As mentioned previously herein, in the present invention, the dopant may be incorporated into the tungsten material according to two alternative doping techniques. In one technique, dopant is added to the reduced tungsten metal powder. In a second doping technique, an undoped tungsten compact is containerized with the dopant, and the container is hot isostatically pressed which causes the dopant to diffuse into the compact. It is not critical to the present invention which of these doping techniques is used.

Traditionally, potassium-containing dopants have been used to dope tungsten for lamp wire manufacture. However, it is known in the art that other dopants can be used. The purpose of the dopant in this invention is to cause formation of previously described bubbles in the tungsten wire which will inhibit the movement of the grain boundaries in the recrystallized filaments to provide an interlocked grain structure which results in a long-life filament. Any material which will serve this purpose can be used as a dopant in the method of this invention. In general, in order to perform this function, the dopant must be insoluble in tungsten and have an atomic radius that is at least about 15%, and preferably about 15% to about 30%, greater than the atomic radius of tungsten. Tungsten has an atomic radius of about 2 angstroms. Thus, suitable dopants for use in this invention generally have an atomic radius of at least about 2.3, and preferably about 2.3 to about 2.6, angstroms.

The atomic radius of the dopant molecule is critical because a molecule having an atomic radius which is too small will be soluble in the tungsten metal, which is undesirable because it results in an ingot having different properties. Dopant molecules having atomic radii greater than the size of the tungsten lattice spaces will not be soluble in the tungsten. These molecules and the tungsten metal form a mixture, which does not change the essential nature of the tungsten ingot.

In general, those additives used in the art to dope tungsten for the purpose of restraining grain growth therein and increasing the strength of the tungsten at elevated temperatures are also suitable for use in the present invention if they have the requisite atomic radius size. These additives include but are not limited to potassium, rubidium, cesium, calcium, strontium, barium, thorium, and the like. Compounds of these elements, for example, oxides, hydroxides and salts, are also suitable for use as dopants in this invention. Examples of suitable compounds include potassium hydroxide, potassium tungstate, thorium dioxide, and the like.

Potassium and potassium hydroxide are the preferred dopants for use in this invention. Potassium hydroxide is the preferred dopant for use in the first doping technique discussed above, i.e., the doping of the tungsten metal powder. It is generally not preferred to use potassium metal in doping the tungsten powder because potassium must be maintained under an inert atmosphere, e.g., nitrogen, which is not easily done during that doping step or during subsequent steps leading up to the containerization procedure. Potassium metal is the preferred dopant for use in the alternative doping technique, i.e., the doping of the tungsten metal green compact in the refractory container, discussed in greater detail below. Maintaining the potassium metal under an inert atmosphere can be effected with greater ease in this doping step, as will also be discussed more fully hereinafter.

The amount of dopant which should be introduced into the tungsten powder or the tungsten green compact will vary according to whether the dopant is in elemental or compound form and further according to the amount of dopant desired in the final ingot.

If the dopant is in elemental form, it should be added to the tungsten in an amount approximately equal to the amount of the element desired in the final ingot since essentially none of the dopant will be lost during processing.

Dopant compounds are believed to thermally decompose during hot isostatic pressing or in a subsequent heat treatment with the result that low molecular weight decomposition products diffuse out of the ingot and the element of the dopant, whether in elemental form or another form, remains in the ingot. As a result, the amount of dopant compound to be introduced into the tungsten metal can be calculated from the amount of the element desired in the ingot according to methods known in the art.

It is not known whether the dopant in the final ingot will be in elemental form or as part of a compound. Nevertheless, whatever its form, the dopant in the final ingot produced in the method of this invention, is sufficient to form the bubbles discussed earlier herein which inhibit grain boundary movement in the recrystallized lamp filament.

About 50 to about 90, and preferably about 70 to about 75, ppm of elemental metallic dopant is generally suitable in the final tungsten ingot. Thus, if potassium metal is the dopant, about 50 to about 90, and preferably about 70 to about 75, ppm potassium metal should be doped into the tungsten metal. Accordingly, if potassium hydroxide is the dopant, about 70 to about 125, and preferably about 100 to about 105, ppm potassium hydroxide should be added to the tungsten metal in order to obtain the above-recited amounts of potassium in the final ingot.

In doping the reduced tungsten metal powder, it is generally preferred to use an aqueous solution of the dopant (except potassium metal, which reacts violently with water to form oxide) so as to ensure greater distribution of the dopant in the tungsten powder. The aqueous dopant solution should contain water in an amount sufficient to form a slurry between the dopant solution and the tungsten. Generally, about 0.3 grams of water per gram of tungsten will be adequate. The mixture of dopant and tungsten powder should be agitated for a time sufficient to thoroughly mix the components. The agitation period will depend on the amount of dopant used with respect to tungsten. For example, if about 100 to about 105 ppm of potassium hydroxide is used, agitation for a period of about 2–5 minutes should be sufficient. After agitation, the mixture is allowed to dry.

The doped tungsten powder, or the undoped tungsten powder if the second doping technique is followed, is then pressed to form a green compact. Any pressing technique which will form a compact is suitable for use in this invention. However, pressing techniques which will form a compact in the shape of a rod having a round or approximately round diameter are preferred. Rods having round or nearly round diameters are preferred because machines used for swaging the final ingot into wire form are equipped to work with rod-shaped ingots having round diameters. Examples of suitable pressing techniques include ram pressing and cold isostatic pressing. Ram pressing results in a rod having a diameter with a round shape flattened on two ends. Cold isostatic pressing is the most preferred process for pressing the powder because it results in a rod having a diameter which is virtually round-shaped. Cold isostatic pressing further provides the resulting compact with a more uniform density, which in turn leads to fairly uniform and predictable shrinking of the ingot during the subsequent hot isostatic pressing step, resulting in the final ingot having a shape in close tolerance to that desired.

Cold isostatic pressing is described in the article, "Cold Isostatic Pressing of Metal Powders", Metals Handbook, 9th Edition, Vol. 7, pp. 444–450, which is incorporated by reference herein in its entirety. Cold isostatic pressing generally refers to a method for processing materials wherein high pressure is applied to a powder part at room temperature to compact it into a predetermined shape. The pressure medium is typically water, oil, rubber, gas, gel, or powder.

Any of the cold isostatic pressing techniques known in the art are suitable for use in this invention. A preferred technique is referred to in the art as "dry bag isostatic pressing" wherein an elastomeric mold is fixed to the inside of a pressure vessel and filled with the tungsten powder. Pressure is applied by introducing pressurized oil between the mold and the vessel wall. Dry bag isostatic pressing is described in greater detail in the article "Cold Isostatic Pressing of Metal Powders", cited and incorporated by reference herein above.

In the method of this invention, the tungsten metal powder is typically subjected to cold isostatic pressing at a pressure in the range of about 30 to about 60 ksi (thousand pounds per square inch).

The rod-shaped compact formed in the above-described step is typically about 27 inches long and 1 inch wide and has a density of about 50 to about 60% of its theoretical density.

If the second doping technique described above is followed, the undoped reduced tungsten metal powder is pressed according to the process described above to form a green compact. As will be more fully discussed below, doping of this compact is effected by containerizing the compact with dopant and then hot isostatically pressing the container.

The undoped tungsten compact and dopant or the doped tungsten compact are containerized in a refractory material. The refractory container will sometimes be referred to herein as a "can" and the containerizing process as "canning."

Typically, in the canning procedure, the tungsten compact is loaded into a refractory can having one open end. If the compact is undoped, the dopant is put in the can first, preferably on the bottom of the can so as to insulate the dopant from the high temperatures used to weld or seal the lid of the can. Insulating the dopant in this way is particularly important if the dopant is potassium metal since potassium will evaporate at the welding temperatures and not diffuse into the tungsten compact. The tungsten compact is placed in the can after the dopant. The lid of the can is put in place and the can is then vacuum sealed or welded.

As mentioned earlier herein, if the dopant is potassium metal, the doping and canning steps must be carried out so as to maintain the potassium under an inert atmosphere to prevent reaction of the potassium with oxygen. This can be accomplished, for example, with the aid of a glass container (commonly known as a "glovebox") containing a nitrogen atmosphere. The refractory can, green compact and a bottle containing potassium in oil are placed in the glovebox which is then flushed with nitrogen to remove all of the oxygen present therein. The potassium is removed from the bottle and washed with an organic solvent such as hexane and dried. The potassium is then cut to the desired weight and placed on the bottom of the can, followed by the green compact and the lid of the can. This assembly is placed in a nitrogen-filled plastic container already present in the glovebox. This container is capped and taken to an electron beam welder for sealing of the refractory can.

In general, refractory cans used in conventional hot isostatic pressing techniques are suitable containers for use in the present invention.

Another can which is suitable for containerizing the compact is a refractory foil encapsulated in silica. Canning is achieved by wrapping the green compact (and dopant, if applicable) in a refractory foil, placing the wrapped compact in a silica can, evacuating the inside of the can, and fusing the end of the can at high temperatures, for example, about 1700° C.

A refractory coating deposited by chemical vapor deposition is also a suitable container for purposes of the present invention. However, this approach for canning the doped tungsten compact would be unwieldy for containerizing the undoped tungsten compact and dopant and is not preferred for use in that situation.

In a general sense, chemical vapor deposition (hereinafter frequently designated "CVD") is the process of depositing a solid product layer on a substrate by a reaction involving one or more precursor compounds of the deposited material in the vapor phase. For example, the chemical vapor deposition of tungsten may be accomplished thermally by the decomposition of a gaseous zerovalent tungsten compound such as tungsten hexacarbonyl. More often, however, it is convenient to employ a compound of the metal in a positive valence state, frequently a halide such as tungsten hexafluoride or in combination with a reducing gas, typically hydrogen.

In the present invention, tungsten hexafluoride is typically used as the tungsten precursor. The reduction reaction which then takes place can be represented by the following equation:

$$WF_{6(g)}+3H_{2(g)}=W_{(s)}+6HF_{(g)}$$

It is preferred that the chemical vapor deposition of the refractory material result in a fine-grained equiaxed layer which is substantially non-columnar. Non-columnar, polycrystalline deposits consist of a number of crystalline grains which are packed very closely together but are not joined together as a single crystal. The grain boundaries between these grains result in weak spots. When a film fails or fractures, it is prone to do so along the grain boundaries. Columnar films are frequently brittle and have low tensile strength by reasons of cracks which can easily propagate through the entire thickness of the film by following the columnar grain boundaries.

In contrast to columnar deposits, equiaxed deposits are generally stronger than columnar films due to the result of increased grain boundary area over which an impinging force can be spread and the indirect path that a crack would take from the top surface to the base of the film. To that end, the CVD process used in the present invention can be carried out according to the method disclosed in commonly-assigned, copending application Ser. No. 364,388, filed June 12, 1989. In that process, the tungsten substrate is heated to a temperature in the range of about 350°–800° C. at a pressure in the range of about 0–20 torrs. The gaseous reactants, i.e., tungsten hexafluoride and hydrogen gas, are metered into the reactant gas inlet tube to premix the reactants in hydrogen/tungsten hexafluoride molar ratios ranging from 5:1 to 10:1. The gaseous reactants are passed into the reaction chamber through the inlet tube and are directed to the surface of the substrate at a velocity gradient effective to produce a deposit substantially free from columnar grains. The term "velocity gradient" is defined as the gas velocity at the inlet tube aperture divided by the distance of the aperture from the surface of the substrate. The preferred minimum value thereof, effective to produce a CVD coating of fine-grained structure, is about 1050 cm./cm.-sec., and the especially preferred minimum which produces an equiaxed grain structure is about 2000 cm./cm.-sec.

However, the above definition of velocity gradient is strictly correct only when the reactor design is such that the flow of the precursor gas stream is directly toward the substrate surface and the vacuum port is on the opposite side of the substrate from the inlet port. If the position of the vacuum port and its distance from the substrate and/or inlet port are such that the precursor gas stream is other than directly toward the substrate—for example, when the port is relatively close to the substrate and at an angle substantially less than 180° C. from the inlet port, such as 90° C.—the velocity gradient is more difficult to calculate, but by reason of the deflection will always be less than as defined above. When such a reactor is used, therefore, the distance of the aperture from the substrate and velocity of the precursor gas stream necessary for the present invention are preferably determined by simple experimentation.

The deposits thereby produced are characterized by a microcrystalline structure consisting substantially of homogeneous fine-grained and preferably equiaxed grains with average grain dimensions less than about 10,000 Angstroms. The hardness, tensile strength and flexibility of these deposits are substantially higher than those of columnar deposits.

The thickness of the CVD-deposited refractory coating is typically in the range of about 5–10 thousandths of an inch.

Any of the known designs of CVD reactors are suitable for use in the present invention. However, particularly desirable for use herein is a cold-wall reaction chamber wherein the rod is heated to the temperature at which the CVD reaction takes place. Heating can be accomplished, for example, inductively, either directly or by using a susceptor (i.e., a body for holding a substrate which is capable of absorbing heat from a source and conducting the heat to the substrate); by direct electrical resistance; by electrical resistance of a heater contained within the substrate; by infrared heating means; by radiant heating or by radio frequency.

The term "refractory material" generally refers to high melting refractory metals and refractory metal compounds which are useful in high temperature applications. Refractory materials suitable for use in the method of this invention are described, for example, in Kirk-Othmer, Encyclopedia of Chemical Tecnology, Third Edition, Vol. 20, pp. 38–64, and include the refractory metals, such as tungsten, molybdenum, niobium, tantalum, rhenium, as well as titanium, hafnium, zirconium, chromium, vanadium, platinum, rhodium, ruthenium, iridium, and osmium. Suitable high melting refractory materials include compounds with high melting points, such as silicides, borides, carbides, nitrides, or oxides, and combinations thereof such as oxycarbides and the like. Mixtures of metals and refractory compounds are also suitable refractory materials for use in this invention.

The preferred refractory materials for use in the present invention are tungsten, molybdenum, tantalum, tungsten foil encapsulated in silica, molybdenum foil encapsulated in silica, tantalum foil encapsulated in silica, or chemically vapor deposited tungsten. The most preferred refractory material is tantalum.

After the canning step, the refractory can containing the doped tungsten ingot or undoped tungsten compact and dopant is then placed into the furnace to be used in the subsequent hot isostatic pressing (sometimes referred to herein as "HIPPING") step.

Hot isostatic pressing is defined in Metals Handbook, 9th Edition, Vol. 7, page 6, as a "process for simultaneously heating and forming a compact in which the powder is contained in a sealed flexible sheet metal or glass enclosure and the so-contained powder is subjected to equal pressure from all directions at a temperature high enough to permit plastic deformation and sintering to take place."

The sealed flexible sheet metal or glass enclosure mentioned in the above definition is sometimes referred to as a "can" or "container". Hot isostatic pressing is discussed in great detail in the article "Hot Isostatic Pressing of Metal Powders", Metals Handbook, 9th Edition, Vol. 7, pp. 419–443, the contents of which are incorporated herein by reference.

Generally, in the hot isostatic pressing process, the refractory can is placed in a resistance furnace located in a water-cooled pressure vessel. Isostatic pressing is applied to the can by pumping a gas, typically argon, into the sealed vessel. Pressures are in the range of about 20,000 to about 30,000 pounds per square inch (psi) and temperatures range from about 1500° C. to about 1700° C. It is to be understood that the pressure to be applied to the can is a function of the temperature used in that at lower temperatures, higher pressures are applied, and vice versa. The hot isostatic pressing time is typically about 2 to about 3 hours.

The HIPPING schedule is typically modified if the can contains the undoped tungsten compact and potassium metal dopant so as to allow adequate time for the potassium to vaporize and diffuse throughout the compact. This is generally accomplished by raising the temperature to about 1600°–1650° C. while applying only enough HIP pressure to offset the potassium pressure within the can. After the temperature reaches about 1600°–1650° C., the pressure is increased to densify the compact. It is generally not necessary to modify the HIPPING schedule if the refractory can contains the potassium hydroxide-doped tungsten compact because the potassium is usually already well distributed.

The tungsten ingot formed from the method of this invention generally has a density of greater than 98% of theoretical density.

The dense tungsten ingot is converted to wire form by hot swaging the ingot and then cutting it to length with diamond saws.

The invention is illustrated by the following examples.

EXAMPLES 1–4 AND COMPARATIVE EXAMPLE 5

In these examples, reduced tungsten powder was isotatically pressed to 60,000 psi (pounds per square inch) to form a green compact in the shape of a rod. Two techniques for doping were used. In Example 1, undoped powder was used to make the green ingot and potassium metal was placed into a tantalum can with the green ingot before the can was welded shut. A piece of potassium metal resulting in an average concentration of 70 ppm with respect to tungsten (the concentration desired in the wire) was included with the ingot.

In Examples 2–4, the powder used to make the green ingot was first mixed with 70 ppm of potassium as potassium hydroxide. A tantalum can was used in Example 2. A tungsten foil can encapsulated in silica was used in Example 3, and a molybdenum foil can encapsulated in silica was used in Example 4.

In Control Example 5, conventionally doped tungsten powder and a CVD tungsten can were used.

In Example 1, the HIP schedule was modified for potassium metal doped ingot to allow adequate time for the potassium to vaporize and diffuse throughout the ingot. This was accomplished by raising the temperature to 1650° C. while applying only enough HIP pressure to offset the potassium pressure within the can. After the temperature reached 1650° C., then the pressure was increased to densify the ingot. It was not necessary to modify the HIP schedule for the potassium hydroxide doped ingots because the potassium was already well distributed.

Subsequent analysis of the samples consisted of scanning electron microscopy and Auger electron spectroscopy of the fracture surface and atomic absorption for bulk potassium concentration.

The ingot formed in the control example using conventionally doped tungsten powder could not make good wire because the chemical composition of the powder was inconsistent for HIP densification in that HIP provides essentially no opportunity for the silicon and aluminum to leave the tungsten material.

The results show even distribution of potassium in spherical voids as is desired, a density of over 98% as compared to 92% using the existing process, and the presence of potassium in fracture surface voids.

Modifications and variations of the present invention are possible in light of the above teachings. It should therefore be understood that changes may be made in the particular embodiments of the invention described which are within the full intended scope of the invention as defined by the appended claims.

What is claimed is:

1. A method for preparing a dense tungsten ingot, comprising hot isostatically pressing at a temperature of about 1500 to about 1700° C. and a pressure of about 20 to about 30 ksi for about 2 to about 3 hours a refractory container comprising a green tungsten metal compact in contact with a dopant, the tungsten metal of the compact being formed prior to contact with the dopant; the dopant being a material which is insoluble in tungsten and contains molecules having atomic radii greater than the atomic radius of tungsten by at least about 15%; and the container comprising a refractory material.

2. A method according to claim 1 wherein the dopant has an atomic radius greater than the atomic radius of tungsten by about 15% to about 30%.

3. A method according to claim 2 wherein the dopant has an atomic radii of at least about 2.3 angstroms.

4. A method according to claim 3 wherein the dopant has an atomic radii of about 2.3 to about 2.6 angstroms.

5. A method according to claim 1 wherein the tungsten comprises particles having an angular or irregular shape.

6. A method according to claim 1 wherein the dopant is in admixture with the tungsten metal of the tungsten compact.

7. A method according to claim 1 wherein the dopant is in contact with the surface of the tungsten metal compact.

8. A method according to claim 1 wherein the tungsten compact is formed by adding the dopant to reduced tungsten metal powder and pressing the doped tungsten powder to form a green compact.

9. A method according to claim 8 wherein the doped powder is pressed to form a compact in the shape of a rod.

10. A method according to claim 9 wherein the doped tungsten powder is cold isostatically pressed at a pressure of about 30,000 to about 60,000 psi to form the green compact.

11. A method according to claim 1 wherein the tungsten compact is formed by pressing undoped reduced tungsten metal powder to form a green compact.

12. A method according to claim 11 wherein the undoped powder is pressed to form a compact in the shape of a rod.

13. A method according to claim 12 wherein the undoped tungsten powder is cold isostatically pressed at a pressure of about 30,000 to about 60,000 psi to form the green compact.

14. A method according to claim 1 wherein the dopant is potassium, rubidium, cesium, calcium, strontium, barium, thorium, or hydroxides or salts of the foregoing.

15. A method according to claim 13 wherein the dopant is potassium or potassium hydroxide.

16. A method according to claim 15 wherein the dopant is potassium.

17. A method according to claim 16 wherein the amount of potassium dopant used is about 50 to about 90 ppm.

18. A method according to claim 17 wherein the amount of potassium dopant used is about 70 to about 75 ppm.

19. A method according to claim 15 wherein the dopant is potassium hydroxide.

20. A method according to claim 19 wherein the amount of potassium hydroxide dopant used is about 70 to about 125 ppm.

21. A method according to claim 20 wherein the amount of potassium hydroxide dopant used is about 100 to about 105 ppm.

22. A method according to claim 1 wherein the container comprises a refractory material selected from the group consisting of tungsten, molybdenum, tantalum, tungsten foil encapsulated in silica, molybdenum foil encapsulated in silica, tantalum foil encapsulated in silica, and chemically vapor deposited tungsten.

23. A method according to claim 22 wherein the refractory material is tantalum.

24. A method for preparing a dense tungsten ingot comprising the steps of:

A. adding a dopant to reduced tungsten metal powder, the dopant being a material which is insoluble in tungsten and contains molecules having atomic radii greater than the atomic radius of tungsten by at least about 15%;

B. cold isostatically pressing at a pressure of about 30,000 to about 60,000 psi the doped tungsten powder to form a green compact;

C. containerizing the tungsten compact in a refractory material; and

D. hot isostatically pressing the containerized tungsten compact at a temperature of about 1500° to about 1700° C. and a pressure of about 20 to about 30 ksi for about 2 to about 3 hours.

25. A method according to claim 24 wherein the dopant is potassium hydroxide.

26. A method according to claim 25 wherein the amount of potassium hydroxide dopant used is about 70 to about 125 ppm.

27. A method according to claim 25 wherein the amount of potassium hydroxide dopant used is about 100 to about 105 ppm.

28. A method according to claim 24 wherein the refractory material is tantalum.

29. A method for preparing a dense tungsten ingot comprising the steps of:

A. cold isostatically pressing undoped reduced tungsten metal powder at a pressure of about 30,000 to about 60,000 psi to form a green compact;

B. containerizing the tungsten compact and a dopant in a refractory material, the dopant being a material which is insoluble in tungsten and contains molecules having atomic radii greater than the atomic radius of tungsten by at least about 15%; and C. hot isostatically pressing the containerized tungsten compact and dopant at a temperature of about 1500° to about 1700° C. and a pressure of about 20 to about 30 ksi for about 2 to about 3 hours.

30. A method according to claim 29 wherein the dopant is potassium.

31. A method according to claim 30 wherein the amount of potassium dopant used is about 50 to about 90 ppm.

32. A method according to claim 31 wherein the amount of potassium dopant used is about 70 to about 75 ppm.

* * * * *